US007185931B1

(12) United States Patent
Vadher

(10) Patent No.: US 7,185,931 B1
(45) Date of Patent: Mar. 6, 2007

(54) HANDHELD POLE DEVICE FOR SCOOPING AND BAGGING VERMIN

(76) Inventor: Dinesh Vadher, 27 W. Pond Ct., Smithtown, NY (US) 11787

( * ) Notice: Subject to any disclaimer, the term of this patent is extended or adjusted under 35 U.S.C. 154(b) by 0 days.

(21) Appl. No.: 11/078,051

(22) Filed: Mar. 11, 2005

(51) Int. Cl.
*E01H 1/12* (2006.01)

(52) U.S. Cl. ..... 294/19.1; 294/55

(58) Field of Classification Search ..... 294/1.3, 294/1.4, 19.1, 55; 43/134, 135; 56/337
See application file for complete search history.

(56) References Cited

U.S. PATENT DOCUMENTS 1,750,163 A * 3/1930 Disney ..... 43/134
4,272,906 A * 6/1981 Liebling ..... 43/11
4,529,236 A * 7/1985 Vogt ..... 294/1.3
4,718,707 A * 1/1988 Greenhut ..... 294/1.4
5,193,870 A * 3/1993 MacInnis et al. ..... 294/1.4
5,305,546 A * 4/1994 Edwards ..... 43/134
5,667,264 A * 9/1997 Tanahara ..... 294/1.4
5,822,908 A * 10/1998 Blanchard ..... 43/11

* cited by examiner

*Primary Examiner*—Dean J. Kramer

(57) ABSTRACT

A handheld pole device for scooping and bagging vermin. The device includes a head, a pole, and a release apparatus. The head is disposable and contacts the ground for scooping and bagging the vermin. The pole extends upwardly from the head for engagement by a hand of a user. The release apparatus is operatively connected to the head and is disposed on the pole for activation by the hand of the user, and when the release apparatus is activated by the hand of the user, the head scoops and bags the vermin.

19 Claims, 3 Drawing Sheets

HANDHELD POLE DEVICE FOR SCOOPING AND BAGGING VERMIN

BACKGROUND OF THE INVENTION

1. Field of the Invention

The present invention relates to a device for scooping vermin, and more particularly, the present invention relates to a handheld pole device for scooping and bagging vermin.

2. Description of the Prior Art

Numerous innovations for vermin disposal devices have been provided in the prior art that will be described infra.

FOR EXAMPLE, U.S. Pat. No. 3,494,067

ANOTHER EXAMPLE, U.S. Pat. No. 3,676,887

STILL ANOTHER EXAMPLE, U.S. Pat. No. 3,978,540 to Peck et al. teaches a disposable pick-up container for animal litter that includes an open-mouthed bag of flexible material serving as a receptacle for the animal litter and having a cuff portion around the mouth thereof, and a pair of scoops on opposite sides of the bag. The scoops each has a blade portion fixed to the cuff portion of the bag and a handle portion extending from the blade portion. The container is adapted for manipulation to pick up the animal litter by grasping the handle portions of the scoops and placing the mouth of the bag around the litter, bringing the blade portions of the scoops together under the litter, picking up the litter by the blade portions and upending the bag to drop the litter by the blade portions and upending the bag to drop the litter thereinto, inserting the blade portions into the bag and thereby also folding the cuff portion so that it lies within the bag, and bringing the handle portions together for bag-closing and carrying purposes.

YET ANOTHER EXAMPLE, U.S. Pat. No. 4,215,888 to Gavin et al. teaches a pick-up device which may consist of a rigid hollow sleeve having a bottom wall, a top wall, and a pair of sidewalls. The sleeve is open at least at one end to receive a corresponding tray having a base wall and at least one, although preferably three, generally upstanding sidewalls defining a substantially continuous rim. The tray is slidably arranged within the sleeve to be movable back and forth between an extended and retracted position. The tray, in its extended position, is placed rim-down over an object or material to be removed so as to cover the object. The tray is then pushed or retracted into the sleeve and thereby scrapes or carries the object into the sleeve for subsequent disposal. The sidewalls of the tray and sleeve may be foldable, if desired, to satisfy requirements for various uses to which the device may be put.

STILL YET ANOTHER EXAMPLE, U.S. Pat. No. 4,529,236 to Vogt teaches a portable device for picking up animal droppings that has a tray, a cover member, and a sheet of flexible material. The cover member is slidingly engaged to the top surface of the tray and a cord handle is attached to one end of the cover for carrying the portable device. The use of the portable device results in the picking up of the animal droppings, while not requiring the person to touch the same. During this operation, the animal droppings are wrapped as a package within the flexible sheet of material as they are both drawn onto the top of the tray beneath the cover member.

YET STILL ANOTHER EXAMPLE, U.S. Pat. No. 5,064,233 to Sloan teaches a disposable animal litter collection device that includes a rigid shovel blade and a shovel handle which extends through the rear edge of the shovel blade and is extendable between a first position and a second position. In the first position, the handle is stored generally adjacent to the shovel blade, and in the second position, the handle extends rearwardly from the shovel blade. A collection bag is fixed to the rear edge of the shovel blade in a manner shielding a user's hand when grasping the handle from animal litter deposited on the shovel blade. This bag is capable of enclosing the shovel blade and any animal litter deposited thereon when the bag is extended over the shovel blade away from the handle to envelope the blade and any litter deposited thereon.

STILL YET ANOTHER EXAMPLE, U.S. Pat. No. 5,271,178 to Eckard teaches an insect or bug removal and disposal device which includes a housing portion with the bottom thereof opened to the atmosphere. A panel portion is inserted and made part of the bottom area of the housing. The panel is positioned to move within such bottom portion. During insect removal, the panel is in the opened or partially opened position and the housing is placed on top of the insect. The panel is then placed in the closed position, trapping the bug or insect within the housing. The bug is thus removed for ultimate disposal. Upon disposal, the panel is opened and the insect is removed from the housing of the device.

YET STILL ANOTHER EXAMPLE, U.S. Pat. No. 5,579,812 to Bigwood teaches a lightweight, portable, and disposable pet feces disposal apparatus. The apparatus includes a full size scoop and an attached disposal bag that both collapse and fold to a size that can be easily carried in a person's pocket or purse.

STILL YET ANOTHER EXAMPLE, U.S. Pat. No. 6,126,215 to Jahns teaches a low cost scoop device for scooping animal waste or other loose material. The scoop contains a disposable bag having an open end. The bag is held open by a collapsible paperboard frame of a unique configuration. The paperboard frame has a bottom element, a first side element, a second side element, and a handle structure. When the paperboard frame is in a deployed configuration, the bottom edge, the first side edge, and the second side edge form a triangular frame with a triangular central opening. The triangular frame holds open the open end of the bag. When the paperboard frame is in a folded configuration, the bottom edge, the first side edge, and the second side edge lay flat atop one another in a compact folded package.

SUMMARY OF THE INVENTION

ACCORDINGLY, AN OBJECT of the present invention is to provide a handheld pole device for scooping and bagging vermin that avoids the disadvantages of the prior art.

ANOTHER OBJECT of the present invention is to provide a handheld pole device for scooping and bagging vermin that is simple to use.

BRIEFLY STATED, STILL ANOTHER OBJECT of the present invention is to provide a handheld pole device for scooping and bagging vermin. The device includes a head, a pole, and a release apparatus. The head is disposable and contacts the ground for scooping and bagging the vermin. The pole extends upwardly from the head for engagement by a hand of a user. The release apparatus is operatively connected to the head and is disposed on the pole for activation by the hand of the user, and when the release apparatus is activated by the hand of the user, the head scoops and bags the vermin.

BRIEF DESCRIPTION OF THE DRAWING

The figures of the drawing are briefly described as follows.

LIST OF REFERENCE NUMERALS UTILIZED IN THE DRAWING

Figure 1:
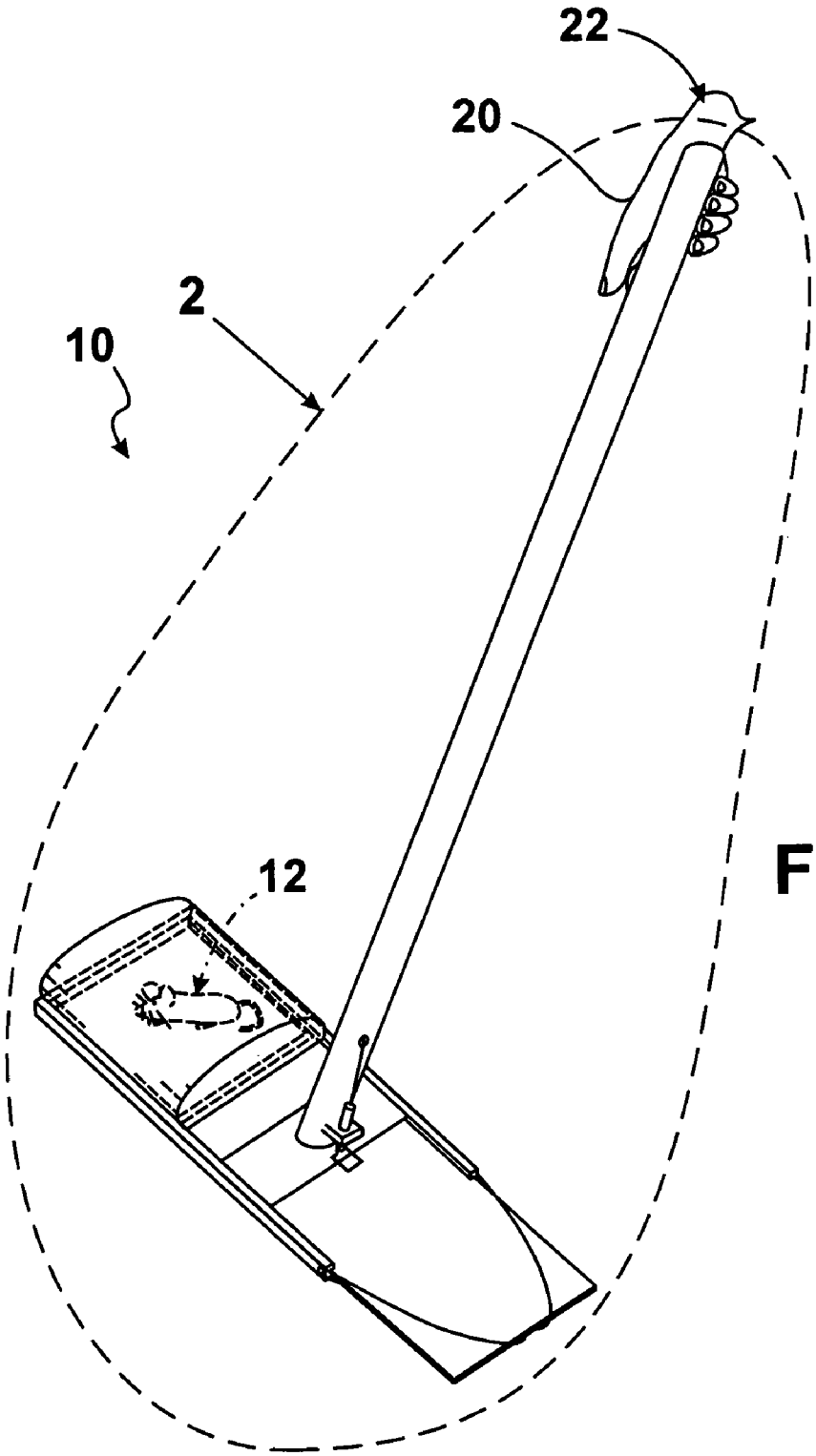
FIG. 1 is a diagrammatic perspective view of the handheld pole device of the present invention scooping and bagging vermin.

10 handheld pole device of present invention for scooping and bagging vermin 12
12 vermin
14 head for contacting ground 20 for scooping and bagging vermin 12
16 pole for engagement by hand 20 of user 22
18 release apparatus for activation by hand 20 of user 22, and when activated by hand 20 of user 22, head 14 scoops and bags vermin 12
20 hand of user 22
21 proximal end of pole 16
22 user
23 distal end of pole 16
24 peripheral frame of head 14
26 scoop of head 14 for scooping vermin 12 when released by release apparatus 18
28 open back of peripheral frame 24 of head 14
30 leading edge of scoop 26 of head 14
31 stop of scoop 26 of head 14
32 upper surface of leading edge 30 of scoop 26 of head 14
34 biasing apparatus of head 14
35 resilient member of biasing apparatus 34 of head 14
38 cross member of peripheral frame 24 of head 14
40 through bore in cross member 38 of peripheral frame 24 of head 14
41 bag of head 14 for capturing vermin 12 when scoop 26 of head 14 achieves closed position thereof
42 plunger assembly of release apparatus 18
44 button assembly of release apparatus 18
45 cord of release apparatus 18
46 bracket of plunger assembly 42 of release assembly 18
48 plunger of plunger assembly 42 of release assembly 18
50 spring of plunger assembly 42 of release assembly 18
51 button of button assembly 44 of release assembly 18
52 slot in proximal end 21 of pole 16 of button assembly 44 of release assembly 18

DETAILED DESCRIPTION OF THE PREFERRED EMBODIMENT

Referring now to the drawings, in which like numerals indicate like parts, and particularly to FIG. 1, which is a diagrammatic perspective view of the handheld pole device of the present invention scooping and bagging vermin, the handheld pole device of the present invention is shown generally at 10 for scooping and bagging vermin 12.

Figure 2:
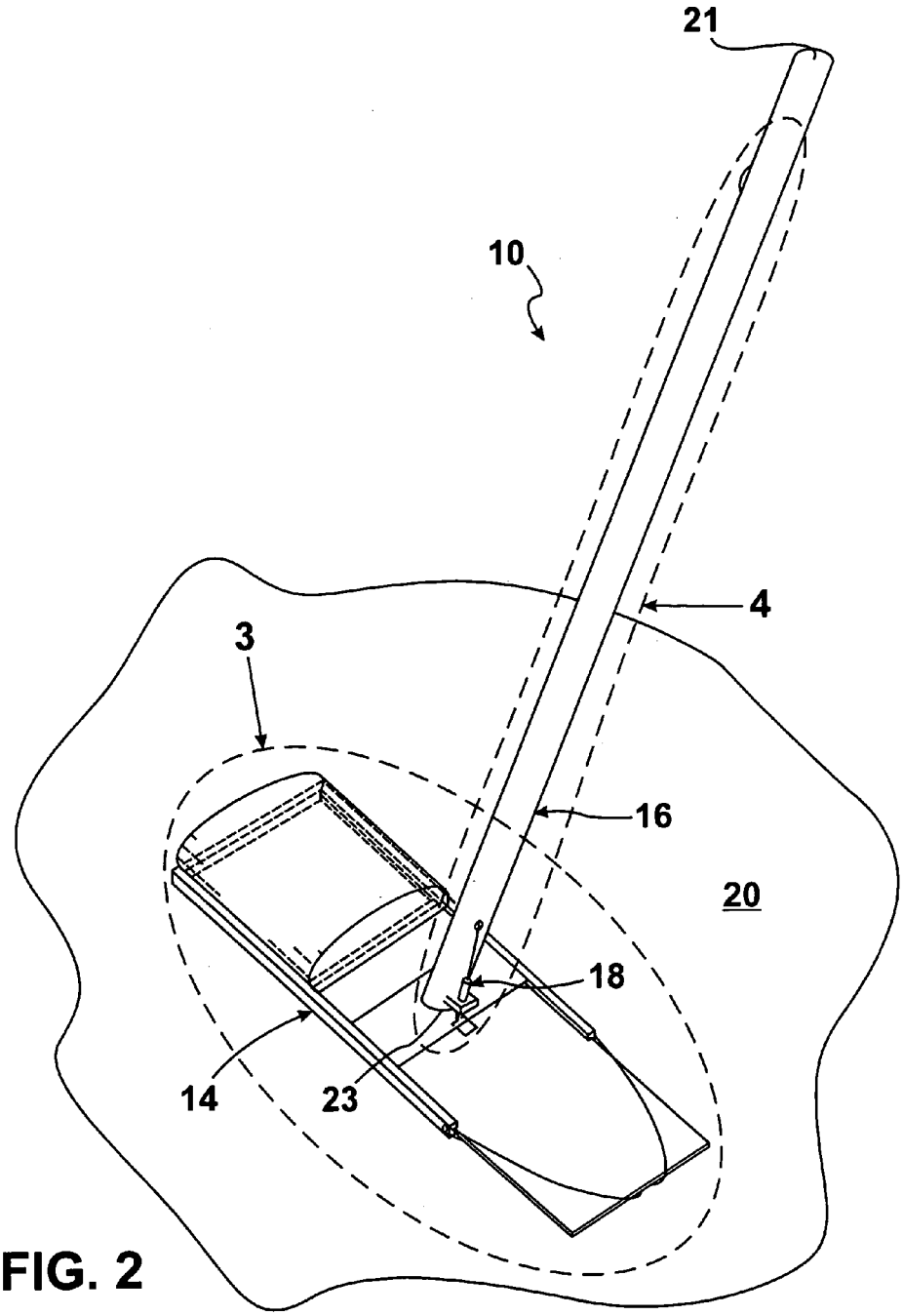
FIG. 2 is an enlarged diagrammatic perspective view of the area generally enclosed by the dotted curve identified by ARROW 2 in FIG. 1 of the handheld pole device of the present invention.

The overall configuration of the handheld pole device 10 can best be seen in FIG. 2, which is an enlarged diagrammatic perspective view of the area generally enclosed by the dotted curve identified by ARROW 2 in FIG. 1 of the handheld pole device of the present invention, and as such, will be discussed with reference thereto.

The handheld pole device 10 comprises a head 14, a pole 16, and a release apparatus 18. The head 14 is disposable and is for contacting the ground 20 for scooping and bagging the vermin 12. The pole 16 extends upwardly from the head 14 for engagement by a hand 20 of a user 22 (FIG. 1) and has a proximal end 21 and a distal end 23. The release apparatus 18 is operatively connected to the head 14 and is disposed on the pole 16 for activation by the hand 20 of the user 22 (FIG. 1), and when the release apparatus 18 is activated by the hand 20 of the user 22, the head 14 scoops and bags the vermin 12.

Figure 3:
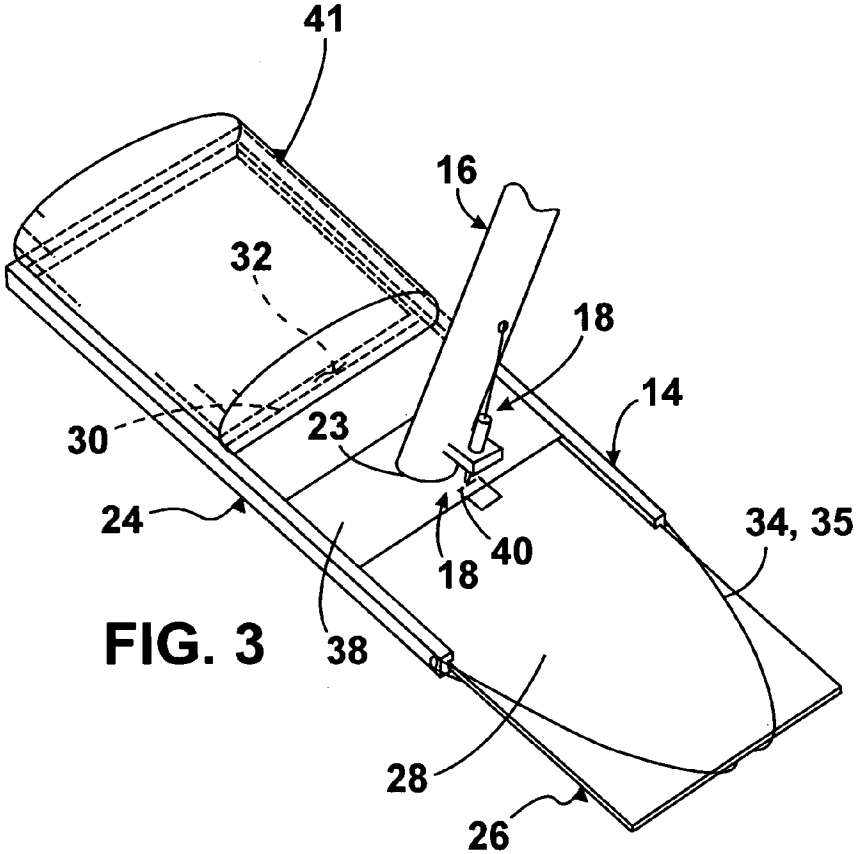
FIG. 3 is an enlarged diagrammatic perspective view of the area generally enclosed by the dotted curve identified by ARROW 3 in FIG. 2 of the head of the handheld pole device of the present invention.

The specific configuration of the head 14 can best be seen in FIG. 3, which is an enlarged diagrammatic perspective view of the area generally enclosed by the dotted curve identified by ARROW 3 in FIG. 2 of the head of the handheld pole device of the present invention, and as such, will be discussed with reference thereto.

The head 14 comprises a peripheral frame 24 and a scoop 26. The scoop 26 of the head 14 is slidable within the peripheral frame 24 of the head 14 and is for scooping the vermin 12 when released by the release apparatus 18.

The peripheral frame 24 of the head 14 is generally U-shaped, lies in a plane, and has an open back 28. The scoop 26 of the head 14 is a plate that slides within the peripheral frame 24 of the head 14, via the open back 28 of the peripheral frame 24 of the head 14, between an open position where the scoop 26 of the head 14 allows the plane of the peripheral frame 24 of the head 14 to be open and a closed position where the scoop 26 of the head 14 closes the plane of the peripheral frame 24 of the head 14.

The scoop 26 of the head 14 has a leading edge 30 and a stop 31. The leading edge 30 of the scoop 26 of the head 14 faces away from the open back 28 of the peripheral frame 24 of the head 14, and has an upper surface 32 that is tapered for scooping under the vermin 12 instead of through the vermin 12, and which has the stop 31 of the scoop 26 of the head 14 therebehind.

The head 14 further comprises biasing apparatus 34. The biasing apparatus 34 of the head 14 is preferably a resilient member 35, such as, but not limited to, a rubber band, a spring, or the like, interconnects the scoop 26 of the head 14 to the peripheral frame 24 of the head 14, and biases the scoop 26 of the head 14 to the closed position thereof, while the release apparatus 18 maintains the scoop 26 of the head 14 in the open position thereof allowing the plane of the peripheral frame 24 of the head 14 to be maintained open allowing the peripheral frame 24 of the head 14 to surround the vermin 12, and when the scoop 26 of the head 14 is released from the open position thereof by the release apparatus 18, the scoop 26 of the head 14 scoops under the vermin 12 closing the plane of the peripheral frame 24 of the head 14, with the vermin 12 resting on the scoop 26 of the head 14.

The peripheral frame 24 of the head 14 further has a cross member 38. The cross member 38 of the peripheral frame 24 of the head 14 extends thereacross, in proximity to the open back 28 thereof, releasably attaches the distal end 23 of the pole 16 thereto, and has a through bore 40.

The head 14 further comprises a bag 41. The bag 41 of the head 14 is releasably attached to the peripheral frame 24 of the head 14, extends from the cross member 38 thereof forwardly, and is for capturing the vermin 12 when the scoop 26 of the head 14 achieves the closed position thereof.

Figure 4:
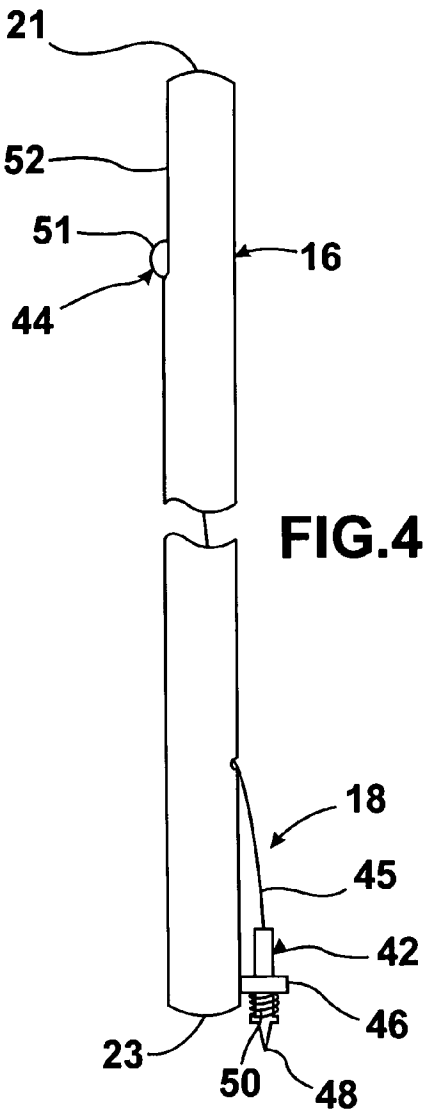
FIG. 4 is an enlarged diagrammatic perspective view of the area generally enclosed by the dotted curve identified by ARROW 4 in FIG. 2 of the release apparatus of the handheld pole device of the present invention.

The specific configuration of the release apparatus 18 can best be seen in FIG. 4, which is an enlarged diagrammatic perspective view of the area generally enclosed by the dotted curve identified by ARROW 4 in FIG. 3 of the release apparatus of the handheld pole device of the present invention, and as such, will be discussed with reference thereto.

The release apparatus 18 comprises a plunger assembly 42 and a button assembly 44. The plunger assembly 42 of the release apparatus 18 is disposed on the distal end 23 of the pole 16, facing towards the open back 28 of the peripheral frame 26 of the head 14, while the button assembly 44 of the release assembly 18 is disposed on the proximal end 21 of the pole 16, diametrically opposing to that of the plunger assembly 42 of the release apparatus 18, and is operatively connected to the plunger assembly 42 of the release assembly 18 by a cord 45 or the like that passes at least in part through the pole 16.

The plunger assembly 42 of the release assembly 18 includes a bracket 46, a plunger 48, and a spring 50. The bracket 46 of the plunger assembly 42 of the release assembly 18 attaches the plunger 48 of the plunger assembly 42 of the release assembly 18 to the distal end 23 of the pole 16 so as to allow the plunger 48 of the plunger assembly 42 of the release assembly 18 to move axially on the pole 16. The spring 50 of the plunger assembly 42 of the release assembly 18 encircles, and biases, the plunger 48 of the plunger assembly 42 of the release assembly 18 into the through bore 40 in the cross member 38 of the peripheral frame 24, and when the scoop 26 of the head 14 is in the open position thereof, the plunger 48 of the plunger assembly 42 of the release assembly 18 also engages the stop 31 of the scoop 26 of the head 14 to maintain the scoop 26 of the head 14 in the open position thereof.

The button assembly 44 of the release assembly 18 includes a button 51 and the proximal end 21 of the pole 16 having a slot 52 axially therein. The button 51 of the button assembly 44 of the release assembly 18 slides in the slot 52 in the proximal end 21 of the pole 16 and is biased towards the distal end 23 of the pole 16 by the spring 50 of the plunger assembly 42 of the release assembly 18, and when moved away from the distal end 23 of the pole 16, the button 51 of the button assembly 44 of the release assembly 18 releases the plunger 48 of the plunger assembly 42 of the release assembly 18 from the stop 31 of the scoop 26 of the head 14 allowing the scoop 26 of the head 14 to achieve the closed position thereof and capture the vermin 12.

The invention claimed is:

1. A handheld pole device for scooping and bagging vermin, comprising:

a) ahead;

b) a pole; and c) a release apparatus;

wherein said head is disposable;

wherein said head is for contacting the ground for scooping and bagging the vermin;

wherein said pole extends upwardly from said head for engagement by a hand of a user;

wherein said pole has a proximal end;

wherein said pole has a distal end;

wherein said release apparatus is operatively connected to said head;

wherein said release apparatus is disposed on said pole for activation by the hand of the user, and when said release apparatus is activated by the hand of the user, said head scoops and bags the vermin;

wherein said head comprises a peripheral frame;

wherein said head comprises a scoop;

wherein said peripheral frame of said head is generally U-shaped;

wherein said peripheral frame of said head lies in a plane;

wherein said peripheral frame of said head has an open back;

wherein said scoop of said head has a leading edge; and wherein said scoop of said head has a stop.

2. The device as defined in claim 1, wherein said scoop of said head is slidable within said peripheral frame of said head; and wherein said scoop of said head is for scooping the vermin when released by said release apparatus.

3. The device as defined in claim 1, wherein said scoop of said head is a plate;

wherein said scoop of said head slides within said peripheral frame of said head, via said open back of said peripheral frame of said head, between an open position where said scoop of said head allows said plane of said peripheral frame of said head to be open and a closed position where said scoop of said head closes said plane of said peripheral frame of said head.

4. The device as defined in claim 3, wherein said head comprises biasing apparatus.

5. The device as defined in claim 4, wherein said biasing apparatus of said head interconnects said scoop of said head to said peripheral frame of said head; and wherein said biasing apparatus of said head biases said scoop of said head to said closed position thereof, while said release apparatus maintains said scoop of said head in said open position thereof allowing said plane of said peripheral frame of said head to be maintained open allowing said peripheral frame of said head to surround the vermin, and when said scoop of said head is released from said open position thereof by said release apparatus, said scoop of said head scoops under the vermin closing said plane of said peripheral frame of said head, with the vermin resting on said scoop of said head.

6. The device as defined in claim 4, wherein said biasing apparatus of said head is a resilient member.

7. The device as defined in claim 1, wherein said leading edge of said scoop of said head faces away from said open back of said peripheral frame of said head; and wherein said leading edge of said scoop of said head has said stop of said scoop of said head therebehind.

8. The device as defined in claim 1, wherein said leading edge of said scoop of said head has an upper surface; and wherein said upper surface of said leading edge of said scoop of said head is tapered for scooping under the vermin, instead of through the vermin.

9. The device as defined in claim 1, wherein said peripheral frame of said head has a cross member.

10. The device as defined in claim 9, wherein said cross member of said peripheral frame of said head extends thereacross;

wherein said cross member of said peripheral frame of said head is disposed in proximity to said open back thereof; and wherein said cross member of said peripheral frame of said head releasably attaches said distal end of said pole thereto.

11. The device as defined in claim 9, wherein said cross member of said peripheral frame of said head has a through bore.

12. The device as defined in claim 9, wherein said head comprises a bag.

13. The device as defined in claim 12, wherein said bag of said head is releasably attached to said peripheral frame of said head;

wherein said bag of said head extends from said cross member thereof forwardly; and wherein said bag of said head is for capturing the vermin when said scoop of said head achieves said closed position thereof.

14. The device as defined in claim 1, wherein said release apparatus comprises a plunger assembly; and wherein said release apparatus comprises a button assembly.

15. The device as defined in claim 14, wherein said plunger assembly of said release apparatus is disposed on said distal end of said pole;

wherein said plunger assembly of said release apparatus faces towards said open back of said peripheral frame of said head;

wherein said button assembly of said release assembly is disposed on said proximal end of said pole;

wherein said button assembly of said release assembly is disposed diametrically opposing to that of said plunger assembly of said release apparatus;

wherein said button assembly of said release assembly is operatively connected to said plunger assembly of said release assembly by a cord; and wherein said cord of said release assembly passes at least in part through said pole.

16. The device as defined in claim 14, wherein said plunger assembly of said release assembly includes a bracket;

wherein said plunger assembly of said release assembly includes a plunger; and wherein said plunger assembly of said release assembly includes a spring.

17. The device as defined in claim 16, wherein said bracket of said plunger assembly of said release assembly attaches said plunger of said plunger assembly of said release assembly to said distal end of said pole so as to allow said plunger of said plunger assembly of said release assembly to move axially on said pole; and wherein said spring of said plunger assembly of said release assembly encircles said plunger of said plunger assembly of said release assembly;

wherein said spring of said plunger assembly of said release assembly biases said plunger of said plunger assembly of said release assembly into said through bore in said cross member of said peripheral frame; and wherein said plunger of said plunger assembly of said release assembly engages said stop of said scoop of said head to maintain said scoop of said head in said open position thereof.

18. The device as defined in claim 16, wherein said button assembly of said release assembly includes a button; and wherein said button assembly of said release assembly includes said proximal end of said pole having a slot axially therein.

19. The device as defined in claim 18, wherein said button of said button assembly of said release assembly slides in said slot in said proximal end of said pole;

wherein said button of said button assembly of said release assembly is biased towards said distal end of said pole by said spring of said plunger assembly of said release assembly; and wherein said release apparatus releases said plunger of said plunger assembly of said release assembly from said stop of said scoop of said head when said button of said button assembly of said release assembly is moved away from said distal end of said pole thereby allowing said scoop of said head to achieve said closed position thereof and capture the vermin.

* * * * *